US009147533B2

(12) United States Patent
Wang

(10) Patent No.: US 9,147,533 B2
(45) Date of Patent: Sep. 29, 2015

(54) BUTTON MECHANISM AND RELATED ELECTRONIC DEVICE

(71) Applicant: Wistron Corporation, New Taipei (TW)

(72) Inventor: Yun-Jun Wang, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 246 days.

(21) Appl. No.: 13/889,357

(22) Filed: May 8, 2013

(65) Prior Publication Data

US 2014/0224630 A1 Aug. 14, 2014

(30) Foreign Application Priority Data

Feb. 8, 2013 (CN) ..... 2013 1 0050864

(51) Int. Cl.
*H01H 3/12* (2006.01)
*H01H 13/52* (2006.01)

(52) U.S. Cl.
CPC ..... *H01H 3/12* (2013.01); *H01H 13/52* (2013.01); *H01H 2221/036* (2013.01)

(58) Field of Classification Search
CPC . H01H 2221/036; H01H 13/52; H01H 13/12; G11B 33/02; G11B 33/12
USPC ..... 720/646, 641, 657; 200/412, 341
See application file for complete search history.

(56) References Cited

U.S. PATENT DOCUMENTS 7,278,147 B2 * 10/2007 Pen ..... 720/646
8,493,742 B2 * 7/2013 Li et al. ..... 361/752
8,495,666 B1 * 7/2013 Fan ..... 720/646
8,547,704 B2 * 10/2013 Kuo ..... 361/752
2011/0036693 A1 2/2011 Lin

FOREIGN PATENT DOCUMENTS

| | | |
|---|---|---|
| TW | M277974 | 10/2005 |
| TW | 201039367 | 11/2010 |
| TW | I373056 | 9/2012 |
| TW | I377566 | 11/2012 |
| TW | I380334 | 12/2012 |

OTHER PUBLICATIONS

Office action mailed on Sep. 11, 2014 for the Taiwan application No. 102109650, filing date: Mar. 19, 2013, p. 1 line 12~14, p. 2~5 and p. 6 line 1~11.

* cited by examiner

*Primary Examiner* — Renee Luebke
*Assistant Examiner* — Doblade Elliott
(74) *Attorney, Agent, or Firm* — Winston Hsu; Scott Margo

(57) ABSTRACT

A button mechanism includes a base, a button and two resilient components. The base includes an accommodating slot structure and two guiding pillars, the pillars are disposed by sides of the accommodating slot structure. The button includes a pressing portion and two supporting portions. The pressing portion is movably disposed inside the accommodating slot structure. The supporting portions are respectively disposed by opposite sides of the pressing portion. A first end of the supporting portion is connected to the pressing portion, and a second end of the supporting portion is slidably disposed on the guiding pillar. Two ends of the resilient component respectively contact against an optical disk driver and the supporting portion. The supporting portion slides relative to the guiding pillar to compress the resilient component, and a resilient recovering force of the resilient component drives the supporting portion to slide relative to the guiding pillar inversely.

20 Claims, 8 Drawing Sheets

BUTTON MECHANISM AND RELATED ELECTRONIC DEVICE

BACKGROUND OF THE INVENTION

1. Field of the Invention

The present invention relates to a button mechanism and a related electronic device, and more particularly, to a button mechanism and a related electronic device with strong structure and stably touching feel.

2. Description of the Prior Art

Please refer to FIG. 1 and FIG. 2. FIG. 1 is an exploded diagram of a button mechanism 10 in prior art. FIG. 2 is an assembly diagram of the button mechanism 10 in prior art. The button mechanism 10 includes a base 12, a body 14 and two resilient arms 16. The body 14 is movably disposed inside a sunken slot 121 on the base 12. The base 12 further includes two guiding bars 123 respectively disposed by sides of the sunken slot 121. Ends of the resilient arms 16 are disposed on a side of the body 14 not adjacent to the guiding bar 123, and the other end of each resilient arm 16 is fixed on the corresponding guiding bar 123. As shown in FIG. 1, the resilient arm 16 is a curved structure, which includes two perpendicular stretching portions 161 and a horizontal stretching portion 163. Two edges of the horizontal stretching portion 163 are respectively connected to the perpendicular stretching portions 161 to form a Z-shaped structure.

As shown in FIG. 2, two ends of the resilient arm 16 are fixed on the body 14 and the guiding bar 123. The resilient arm 16 is resiliently deformed when the body 14 is pressed, and the body 14 moves relative to the sunken slot 121 to drive an external electronic switch. However, the resilient arm 16 is the Z-shaped structure, which forms structural defect easily due to difficult manufacturing, and the resilient arm 16 is easy to be resiliently deformed unexpectedly. In addition, the button mechanism 10 has small structural configuring space, the resilient arm 16 is often designed as thin-typed structure, which is easily broken or losses resilient recovering force after long-period operation, and the button mechanism 10 can not provide touching feel. Thus, design of a button mechanism having strong structure and stably touching feel is an important issue in the computer mechanical design industry.

SUMMARY OF THE INVENTION

The present invention provides a button mechanism and a related electronic device with strong structure and stably touching feel for solving above drawbacks.

According to the claimed invention, a button mechanism is disposed on an optical disk drive. The button mechanism includes a base, a button and two resilient components. The base includes an accommodating slot structure and two guiding pillars, the guiding pillars are respectively disposed by sides of the accommodating slot structure. The button includes a pressing portion and two supporting portions. The pressing portion is movably disposed inside the accommodating slot structure. The supporting portions are respectively disposed by opposite sides of the pressing portion. A first end of the supporting portion is connected to the pressing portion, and a second end of the supporting portion opposite to the first end is slidably disposed on the guiding pillar. The resilient components are disposed on the corresponding guiding pillars. Two ends of the resilient component respectively contact against the optical disk driver and the second end of the supporting portion. The resilient component stores a resilient recovering force when the supporting portion slides relative to the guiding pillar at a predetermined direction to compress the resilient component, and the resilient recovering force drives the supporting portion to slide relative to the guiding pillar at a direction opposite to the predetermined direction.

According to the claimed invention, the first end of each supporting portion is substantially disposed on a middle of a side of the pressing portion.

According to the claimed invention, the supporting portion is a perpendicular stretching portion disposed on a side of the pressing portion adjacent to the guiding pillar.

According to the claimed invention, the supporting portion is an erect bar.

According to the claimed invention, the button mechanism further includes at least one clamping component disposed on the base. The clamping component includes two contacting blocks disposed by each other, and the contacting blocks respectively contact against two sides of the supporting portion.

According to the claimed invention, the supporting portion is a rectangular structure, the contacting blocks respectively clamp opposite lateral surfaces of the first end of the supporting portion.

According to the claimed invention, a guiding slot is formed between the contacting blocks, and a slotting direction of the guiding slot is substantially parallel to a structural direction of the guiding pillar.

According to the claimed invention, a first engaging portion is disposed on an inner lateral wall of the accommodating slot structure, a second engaging portion is disposed on an outer lateral wall of the pressing portion, and the first engaging portion is slidably engaged with the second engaging portion.

According to the claimed invention, the supporting portion is connected to the pressing portion in a resiliently bending manner.

According to the claimed invention, the resilient component is a compressive spring or an annular rubber.

According to the claimed invention, an electronic device includes an optical disk drive and a button mechanism. The button mechanism is disposed by the optical disk drive for actuating a switch of the optical disk drive. The button mechanism includes a base, a button and two resilient components. The base includes an accommodating slot structure and two guiding pillars, the guiding pillars are respectively disposed by sides of the accommodating slot structure. The button includes a pressing portion and two supporting portions. The pressing portion is movably disposed inside the accommodating slot structure. The supporting portions are respectively disposed by opposite sides of the pressing portion. A first end of the supporting portion is connected to the pressing portion, and a second end of the supporting portion opposite to the first end is slidably disposed on the guiding pillar. The resilient components are disposed on the corresponding guiding pillars. Two ends of the resilient component respectively contact against the optical disk driver and the second end of the supporting portion. The resilient component stores a resilient recovering force when the supporting portion slides relative to the guiding pillar at a predetermined direction to compress the resilient component, and the resilient recovering force drives the supporting portion to slide relative to the guiding pillar at a direction opposite to the predetermined direction.

The button mechanism of the present invention has advantages of simple structure and easy operation. The drawing die is not generated when manufacturing the erect supporting portion, so that structural strength and stability of the button (combined with the supporting portion and the pressing portion) can be increased. The button mechanism of the present invention disposes the erect supporting portion on two ends of the stretching line of the gravity of the pressing portion, and replaces the conventional arm by the resilient component for providing the uniformly resilient recovering force, so as to enhance the touching feel and product yield of the button mechanism for increasing market competition.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
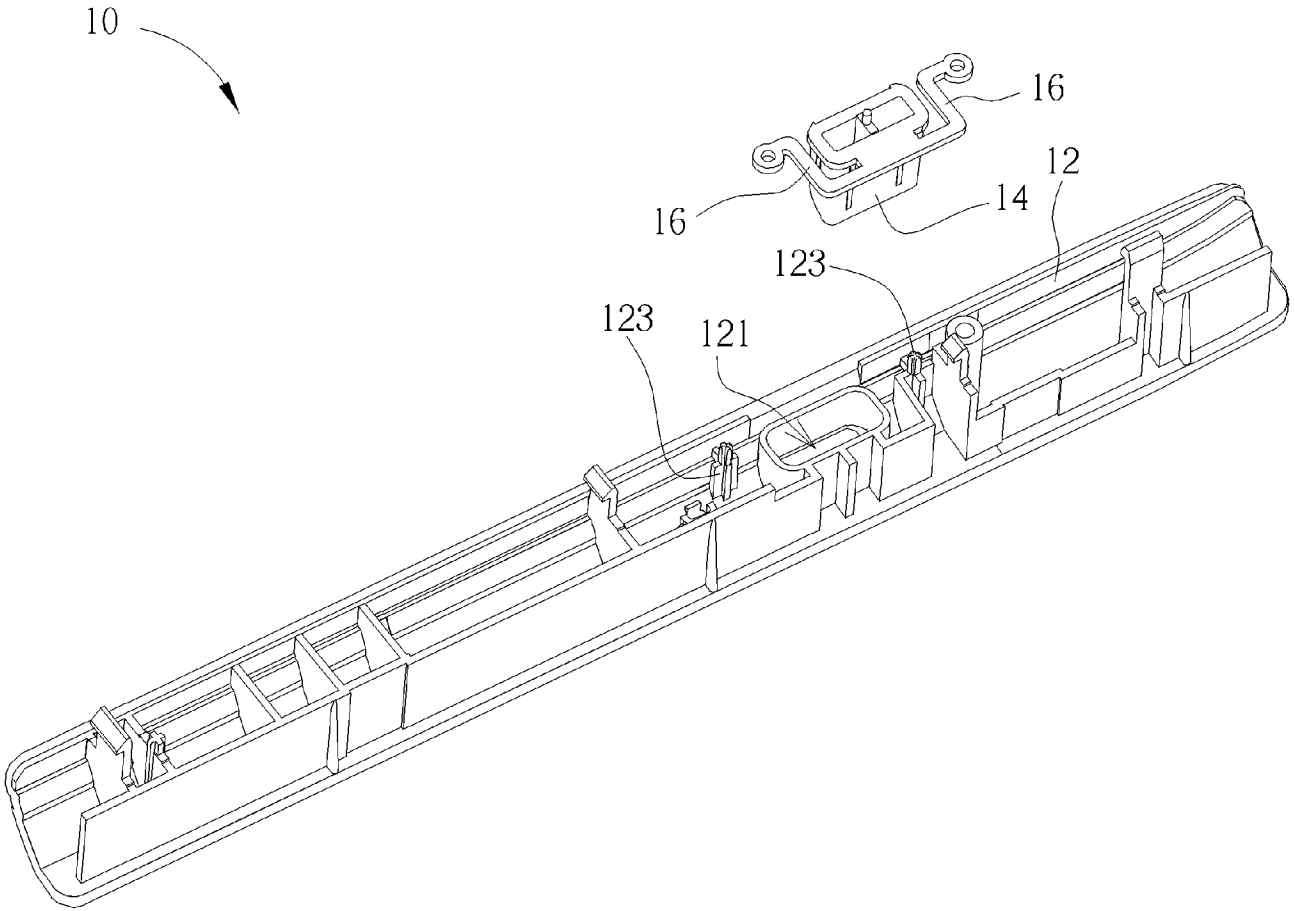
FIG. 1 PRIOR ART
FIG. 1 is an exploded diagram of a button mechanism in prior art.
Figure 2:
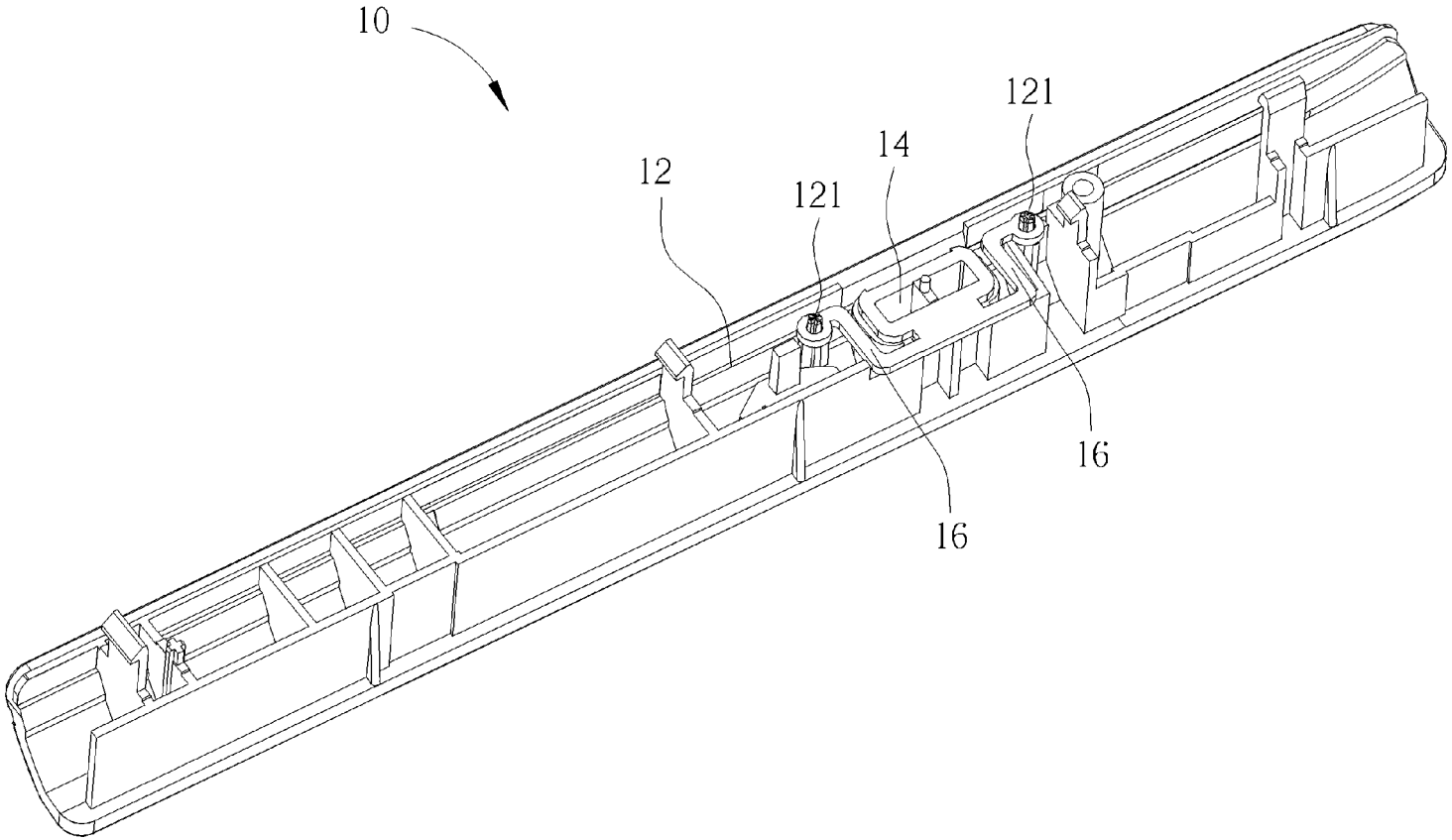
FIG. 2 PRIOR ART
FIG. 2 is an assembly diagram of the button mechanism in prior art.
Figure 3:
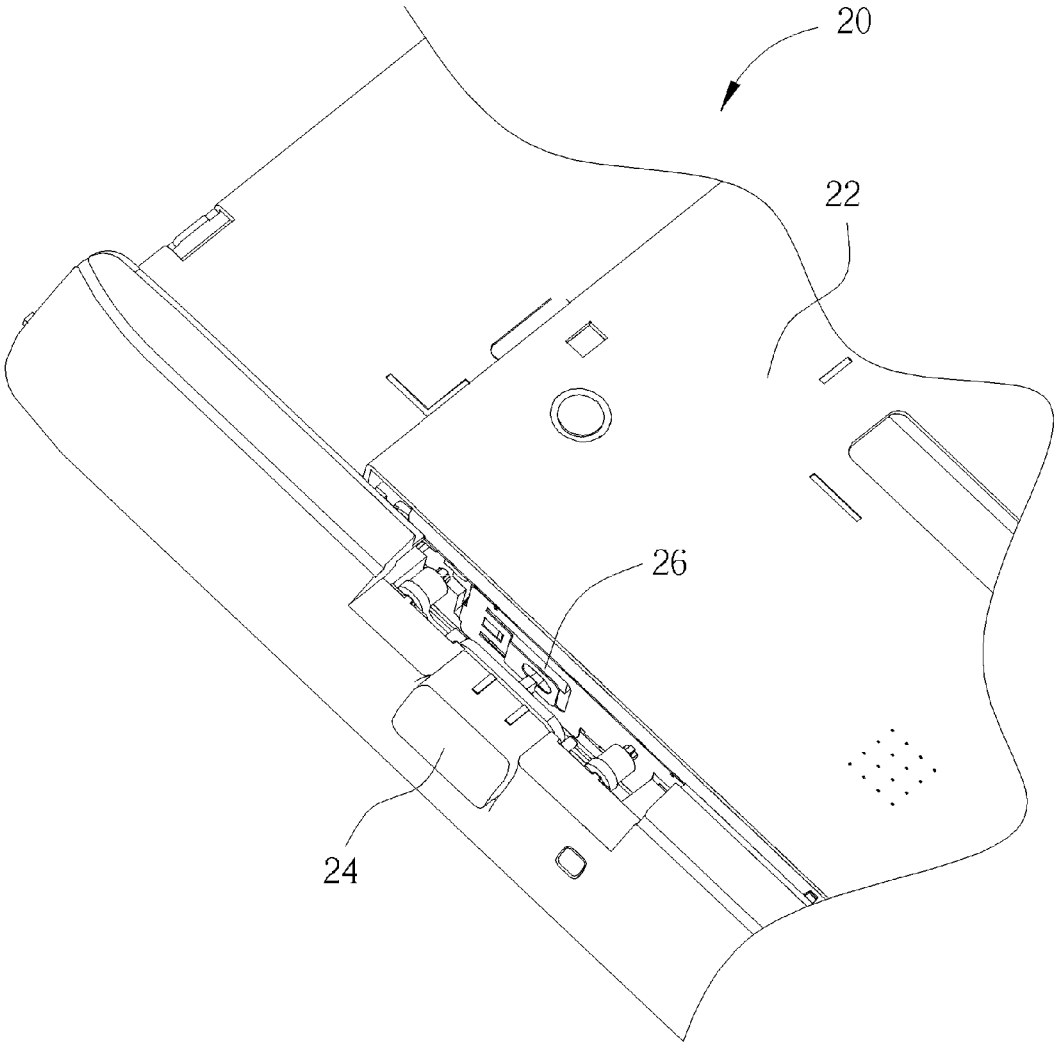
FIG. 3 is a diagram of an electronic device according to an embodiment of the present invention.

Please refer to FIG. 3. FIG. 3 is a diagram of an electronic device 20 according to an embodiment of the present invention. The electronic device 20 includes an optical disk drive 22 and a button mechanism 24. The button mechanism 24 is disposed by the optical disk drive 22, and the user can press the button mechanism 24 to actuate a switch 26 of the optical disk drive 22. The button mechanism 24 of the present invention not only can prevent the pressing function from inefficacy due to permanent deformation of the resilient component as the prior art, but also provide stable guiding function, so that a button of the button mechanism 24 is not shifted when moving, and the button mechanism 24 can have preferred touching feel.

Figure 4:
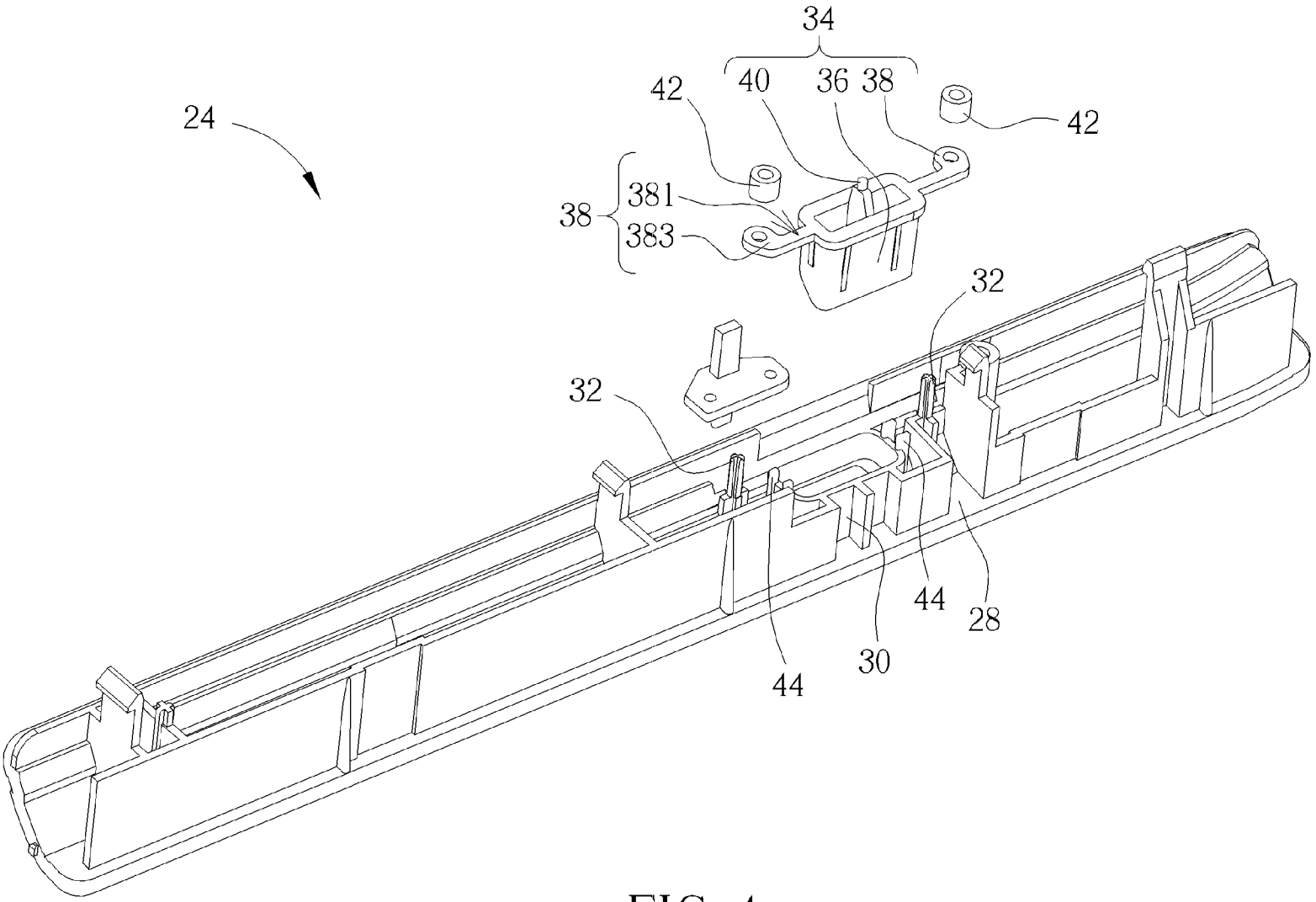
FIG. 4 is an exploded diagram of a button mechanism according to the embodiment of the present invention.
Figure 5:
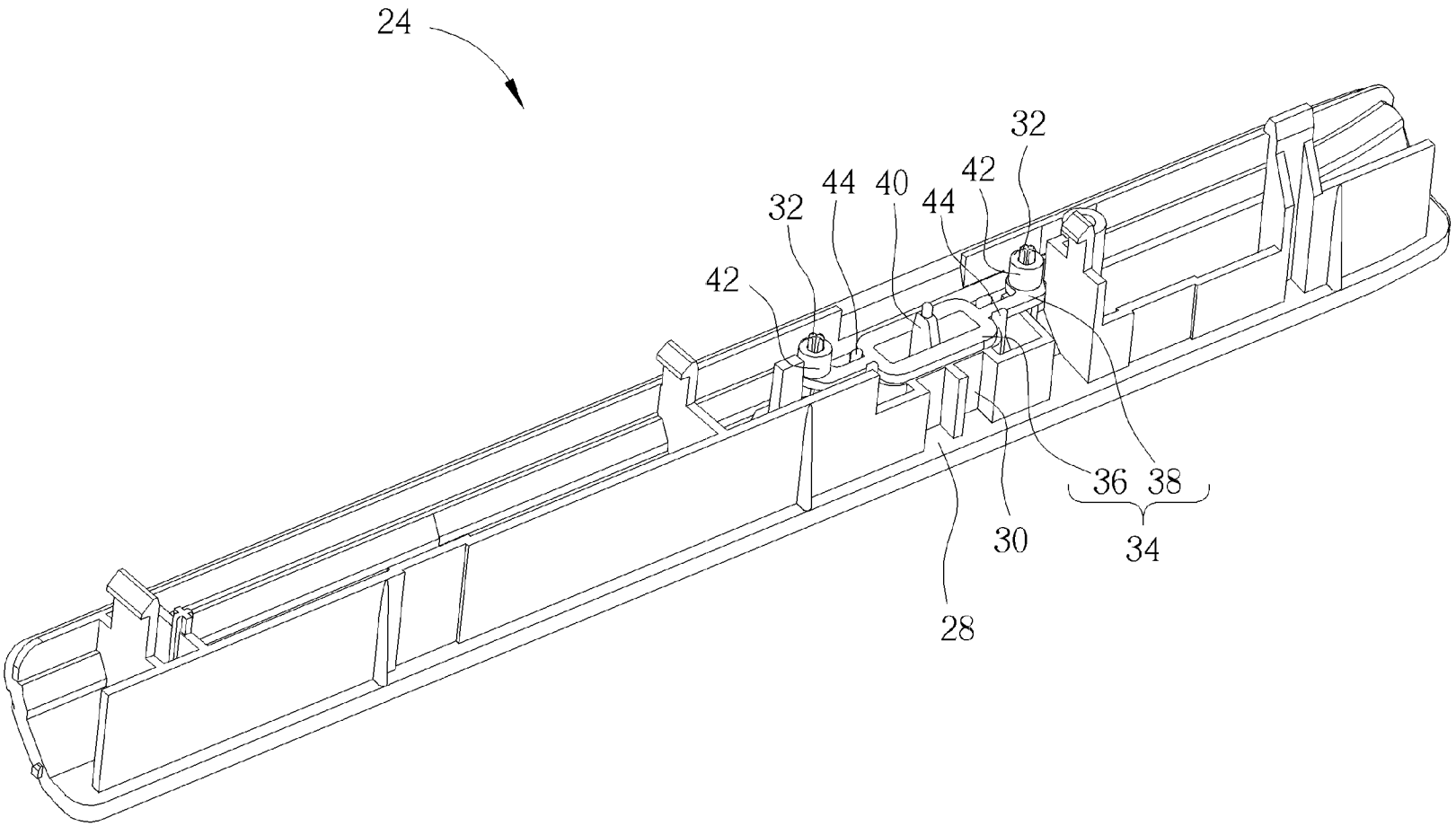
FIG. 5 is an assembly diagram of the button mechanism according to the embodiment of the present invention.

Please refer to FIG. 4 and FIG. 5. FIG. 4 is an exploded diagram of the button mechanism 24 according to the embodiment of the present invention. FIG. 5 is an assembly diagram of the button mechanism 24 according to the embodiment of the present invention. The button mechanism 24 includes a base 28. The base 28 includes an accommodating slot structure 30 and two guiding pillars 32. The guiding pillars 32 are respectively disposed by sides of the accommodating slot structure 30. The button mechanism 24 further includes a button 34. The button 34 includes a pressing portion 36, two supporting portions 38 and an actuating portion 40. The pressing portion 36 is movably disposed inside the accommodating slot structure 30. The supporting portions 38 are respectively disposed on two opposite sides of the pressing portion 36. A first end 381 of each supporting portion 38 is connected to the pressing portion 36, and a second end 383 of each supporting portion 38 opposite to the first end 381 is slidably disposed on the guiding pillar 32. The actuating portion 40 is disposed on a surface of the pressing portion 36 that is opposite to a touching surface (not shown in figures) for the user. As the user presses the touching surface of the button 34, the button 34 moves relative to the base 28, and the switch 26 is actuated by the actuating portion 40.

The button mechanism 24 further includes two resilient components 42 respectively disposed on the corresponding guiding pillars 32. The resilient component 42 can be a compressive spring or an annular rubber, selectively. The resilient component 42 can store a resilient recovering force when the button 34 is pressed and deformed. As the button 34 is pressed, the supporting portion 38 of the button 34 can slide along the guiding pillar 32 to compress the resilient component 42. Application of the resilient component 42 is not limited to the above-mentioned embodiment, which depends on actual demand, and a detailed description is omitted herein for simplicity. When the resilient component 42 is disposed on the guiding pillar 32, two ends of the resilient component 42 respectively contact against a supporting wall (not shown in the figures) of the optical disk drive 22 and the second end 383 of the supporting portion 38. The supporting portion 38 slides relative to the guiding pillar 32 at a predetermined direction when the button 34 is pressed. The resilient recovering force of the resilient component 42 can drive the supporting portion 38 to slide relative to the guiding pillar 32 at a direction opposite to the predetermined direction, so as to move the button 34 back to an initial position.

As shown in FIG. 4 and FIG. 5, the first end 381 of the supporting portion 38 can be substantially disposed on a middle of a side of the pressing portion 36, so that an external force applied to the pressing portion 36 does not form the moment relative to the pressing portion 36 and the supporting portion 38 when the button 34 moves relative to the base 28, and the button mechanism 24 can prevent the button 34 from twisting as operating. Further, the supporting portion 38 can be a perpendicular stretching portion disposed on a lateral side of the pressing portion 36 adjacent to the guiding pillar 32, which means the supporting portion 38 is an erect bar, and the two supporting portion 38 are respectively disposed over an outwardly stretching line of gravity of the pressing portion 36. Therefore, the external force applied to the pressing portion 36 can compress the resilient component 42 via a combination of the supporting portion 38 and the guiding pillar 32, so the supporting portion 38 is not twisted and the pressing portion 36 does not rotate.

Figure 6:
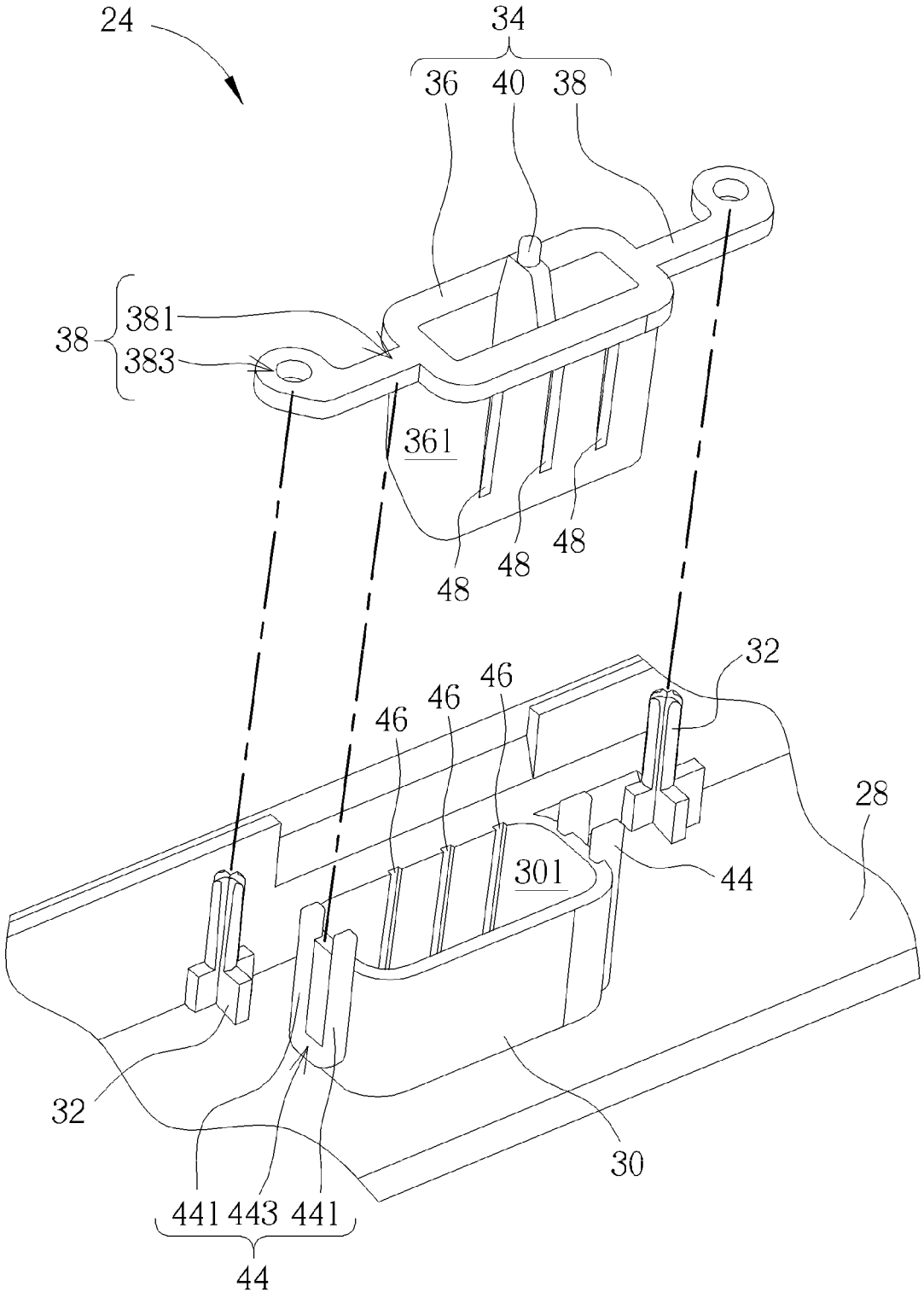
FIG. 6 is a diagram of part of the button mechanism according to the embodiment of the present invention.

In addition, the button mechanism 24 further can include at least one clamping component 44 disposed on the base 28. Please refer to FIG. 6. FIG. 6 is a diagram of part of the button mechanism 24 according to the embodiment of the present invention. The clamping component 44 includes two contacting blocks 441 disposed by each other, and the contacting blocks 441 respectively contact against two sides of the supporting portion 38 for tight clamp. A guiding slot 443 is formed between the contacting blocks 441. A slotting direction of the guiding slot 443 can be substantially parallel to a structural direction of the guiding pillar 32. When the button 34 moves relative to the base 28, a moving direction of the button 34 can be constrained by a combination of the guiding pillar 32 whereon the second end 383 of the supporting portion 38 is disposed and a combination of the guiding slot 443 whereinside the first end 381 of the supporting portion 38 is disposed, so that the actuating portion 40 of the button 34 can accurately actuate the switch 26. Besides, as shown in FIG. 6, the supporting portion 38 can be a rectangular structure. The two contacting blocks 441 can respectively clamp opposite lateral surfaces of the supporting portion 38 (the first end 381), to effectively prevent the button 34 from twisting when moving inside the accommodating slot structure 30.

A plurality of first engaging portions 46 can be disposed on an inner lateral wall 301 of the accommodating slot structure 30, and a plurality of second engaging portions 48 can be disposed on an outer lateral wall 361 of the pressing portion 36. The pressing portion 36 inserts into the accommodating slot structure 30 for relative slide when the button 34 moves relative to the base 28. In the meantime, each first engaging portion 46 is slidably engaged with the corresponding second engaging portion 48, to effectively prevent the button 34 from unexpected twisting as pressing and to accurately actuate the switch 26 by the actuating portion 40 of the button 34. Generally, the button mechanism 24 in this embodiment of the present invention preferably utilizes the resilient recovering force of the resilient component 42 to recover the button 34. The supporting portion 38 can be made of resilient material, which means the supporting portion 38 is connected to the pressing portion 36 is a resiliently bending manner, and the button mechanism 24 can integrate the resilient recovering force of the resilient component 42 and the supporting portion 38 for preferred operationally recovering feel.

Figure 7:
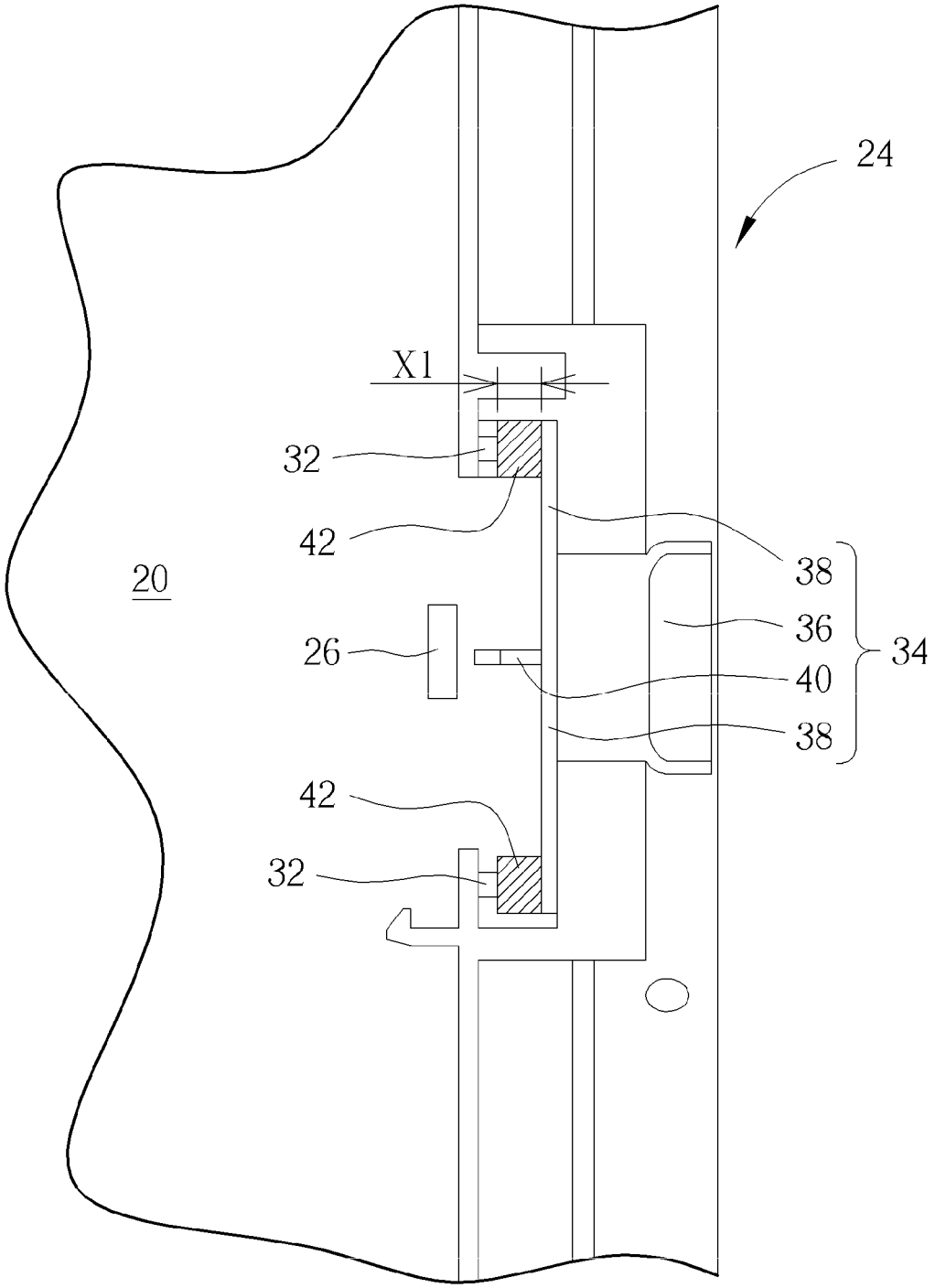
FIG. 7 and FIG. 8 respectively are diagrams of the electronic device in different modes according to the embodiment of the present invention.
Figure 8:
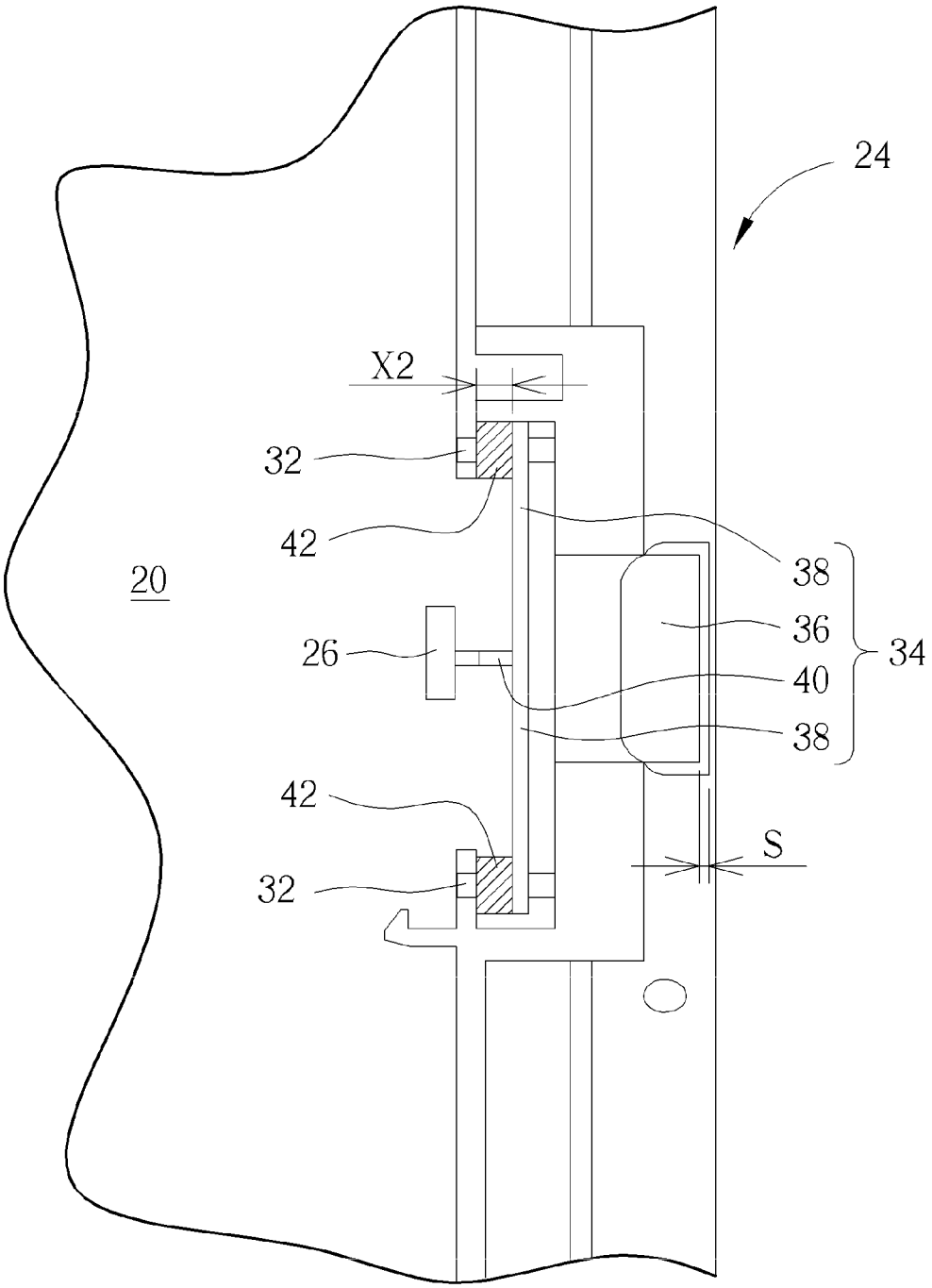

Please refer to FIG. 7 and FIG. 8. FIG. 7 and FIG. 8 respectively are diagrams of the electronic device 20 in different modes according to the embodiment of the present invention. As shown in FIG. 7, the button mechanism 24 is at an initial mode. The button 34 is not pressed, the switch 26 is not actuated by the actuating portion 40, and the resilient component 42 is not deformed. As shown in FIG. 8, the supporting portion 38 slides along the guiding pillar 32 to compress the resilient component 42 when the pressing portion 36 is pressed, and the actuating portion 40 moves close to the switch 26 for actuating the switch 26. A movement S of the button 34 can be substantially equal to different between an initial thickness X1 and a compressed thickness X2 of the resilient component 42. The resilient deformation of the resilient component 42 can provide stable and uniform recovering force to the button 34.

In conclusion, the button mechanism of the present invention disposes the supporting portion on the middle of the lateral side of the pressing portion adjacent to the guiding pillar, so that the moment is not generated and the pressing portion is not twisted when operating the button. In addition, the supporting portion, which has no resilience, is recovered by the resilient recovering force of the resilient component. The button mechanism of the present invention utilizes the resilient component disposed on the guiding pillar to transform the external force applied to the button into the resilient recovering force, and the resilient recovering force can drive the button to recover when the external force is removed. Because the button mechanism does not utilize the supporting portion to provide the resilient recovering force, the supporting portion can be designed as the erect bar with perpendicular stretching form, to effectively prevent conventional drawbacks of the thin-curved resilient arm, such as difficult manufacturing (drawing die is formed accordingly) and resilient fatigue (the thin-curved resilient arm is broken easily). The button mechanism of the present invention further utilizes the clamping component disposed on the first end of the supporting portion to effectively prevent the button from unexpected rotation by constraint design of a clamped position of the supporting portion whereon the clamping component is disposed, and the lateral surfaces of the rectangular supporting portion clamped by the clamping component.

Comparing to the prior art, the button mechanism of the present invention has advantages of simple structure and easy operation. The drawing die is not generated when manufacturing the erect supporting portion, so that structural strength and stability of the button (combined with the supporting portion and the pressing portion) can be increased. The button mechanism of the present invention disposes the erect supporting portion on two ends of the stretching line of the gravity of the pressing portion, and replaces the conventional arm by the resilient component for providing the uniformly resilient recovering force, so as to enhance the touching feel and product yield of the button mechanism for increasing market competition.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A button mechanism disposed on an optical disk drive, the button mechanism comprising:

a base, the base comprising an accommodating slot structure and two guiding pillars, the guiding pillars being respectively disposed by sides of the accommodating slot structure;

a button, the button comprising:

a pressing portion movably disposed inside the accommodating slot structure; and two supporting portions respectively disposed by opposite sides of the pressing portion, a first end of one of the supporting portions being connected to the pressing portion, a second end of the supporting portion opposite to the first end being slidably disposed on one of the guiding pillars; and two resilient components respectively disposed on the two guiding pillars, two ends of one of the resilient components respectively contacting against the optical disk drive and the second end of the supporting portion, the resilient component storing a resilient recovering force when the supporting portion slides relative to the guiding pillar in a predetermined direction to compress the resilient component, and the resilient recovering force driving the supporting portion to slide relative to the guiding pillar in a direction opposite to the predetermined direction.

2. The button mechanism of claim 1, wherein the first end of each supporting portion is substantially disposed on a middle of a side of the pressing portion.

3. The button mechanism of claim 1, wherein the supporting portion is a perpendicular stretching portion disposed on a side of the pressing portion adjacent to the guiding pillar.

4. The button mechanism of claim 3, wherein the supporting portion is an erect bar.

5. The button mechanism of claim 1, further comprising:

at least one clamping component disposed on the base, the clamping component comprising two contacting blocks disposed by each other, and the contacting blocks respectively contacting against two sides of the supporting portion.

6. The button mechanism of claim 5, wherein the supporting portion is a rectangular structure, the contacting blocks respectively clamp opposite lateral surfaces of the first end of the supporting portion.

7. The button mechanism of claim 5, wherein a guiding slot is formed between the contacting blocks, and a slotting direction of the guiding slot is substantially parallel to a structural direction of the guiding pillar.

8. The button mechanism of claim 1, wherein a first engaging portion is disposed on an inner lateral wall of the accommodating slot structure, a second engaging portion is disposed on an outer lateral wall of the pressing portion, and the first engaging portion is slidably engaged with the second engaging portion.

9. The button mechanism of claim 1, wherein the supporting portion is connected to the pressing portion in a resiliently bending manner.

10. The button mechanism of claim 1, wherein the resilient component is an annular rubber.

11. An electronic device comprising:

an optical disk drive having a switch; and a button mechanism disposed by the optical disk drive for actuating the switch of the optical disk drive, the button mechanism comprising:

a base, the base comprising an accommodating slot structure and two guiding pillars, the guiding pillars being respectively disposed by sides of the accommodating slot structure;

a button, the button comprising:

a pressing portion movably disposed inside the accommodating slot structure; and two supporting portions respectively disposed by opposite sides of the pressing portion, a first end of one of the supporting portions being connected to the pressing portion, a second end of the supporting portion opposite to the first end being slidably disposed on one of the guiding pillars; and two resilient components respectively disposed on the two guiding pillars, two ends of one of the resilient components respectively contacting against the optical disk drive and the second end of the supporting portion, the resilient component storing a resilient recovering force when the supporting portion slides relative to the guiding pillar in a predetermined direction to compress the resilient component, and the resilient recovering force driving the supporting portion to slide relative to the guiding pillar in a direction opposite to the predetermined direction.

12. The electronic device of claim 11, wherein the first end of each supporting portion is substantially disposed on a middle of a side of the pressing portion.

13. The electronic device of claim 11, wherein the supporting portion is a perpendicular stretching portion disposed on a side of the pressing portion adjacent to the guiding pillar.

14. The electronic device of claim 13, wherein the supporting portion is an erect bar.

15. The electronic device of claim 11, wherein the button mechanism further comprises:

at least one clamping component disposed on the base, the clamping component comprising two contacting blocks disposed by each other, and the contacting blocks respectively contacting against two sides of the supporting portion.

16. The electronic device of claim 15, wherein the supporting portion is a rectangular structure, the contacting blocks respectively clamp opposite lateral surfaces of the first end of the supporting portion.

17. The electronic device of claim 15, wherein a guiding slot is formed between the contacting blocks, and a slotting direction of the guiding slot is substantially parallel to a structural direction of the guiding pillar.

18. The electronic device of claim 11, wherein a first engaging portion is disposed on an inner lateral wall of the accommodating slot structure, a second engaging portion is disposed on an outer lateral wall of the pressing portion, and the first engaging portion is slidably engaged with the second engaging portion.

19. The electronic device of claim 11, wherein the supporting portion is connected to the pressing portion in a resiliently bending manner.

20. The electronic device of claim 11, wherein the resilient component is an annular rubber.

* * * * *